United States Patent [19]

Du Broff

[11] 4,178,739

[45] Dec. 18, 1979

[54] CONSTRUCTION FOR APPLYING TAPE

[75] Inventor: Warren Du Broff, Highland Park, Ill.

[73] Assignee: Lathrop Paulson Company, Chicago, Ill.

[21] Appl. No.: 874,267

[22] Filed: Feb. 1, 1978

[51] Int. Cl.[2] ..... B65B 13/04

[52] U.S. Cl. ..... 53/588; 53/139.3; 53/210; 156/486

[58] Field of Search ..... 53/137, 139.3, 210, 53/218, 588, 589, 590; 100/27; 156/468, 486

[56] References Cited

U.S. PATENT DOCUMENTS

| | | | |
|---|---|---|---|
| 2,097,383 | 10/1937 | Riemer | 53/137 |
| 2,504,059 | 4/1950 | Weber | 156/468 X |
| 2,504,060 | 4/1950 | Weber | 156/468 |
| 2,782,709 | 2/1957 | French et al. | 100/27 |
| 2,972,843 | 2/1961 | Du Brof | 53/588 |
| 3,008,297 | 10/1961 | Broadhead et al. | 53/588 |
| 3,019,577 | 2/1962 | Slamar | 53/589 |
| 3,600,253 | 8/1971 | Derenthal | 100/27 X |
| 3,775,939 | 12/1973 | Elsner | 53/586 |

*Primary Examiner*—John Sipos

*Attorney, Agent, or Firm*—McDougall, Hersh & Scott

[57] ABSTRACT

A construction for applying tape around the perimeter of an object wherein a supply of the tape is provided on a spool. An end of the tape is clamped, and the spool is then transported around the object with the tape then unreeling and being pressed into engagement with the object. Independently driven roller means are mounted for movement back and forth over one surface of the object, these roller means pressing respective tape ends onto the surface in overlapping relationship. This action is synchronized with clamping and severing action to prepare the system for a succeeding operation. The object to be taped is moved into position by means of a conveyor and a vertical lift. Stop means control the extent of movement of the lift, and this feature combined with the tape-applying mechanism makes the construction operable for a wide range of sizes of objects to be taped.

11 Claims, 13 Drawing Figures

CONSTRUCTION FOR APPLYING TAPE

BACKGROUND OF THE INVENTION

For a large number of reasons, it is desirable to tape objects. For example, a stack of otherwise independent objects can be held together for handling purposes by applying a strip of tape around the objects.

The taping of an object can, and often is, performed manually. However, in cases where the taping must be repeated, for example in a production line operation, it is desirable to provide machinery for applying the tape. Thus, where suitable machinery is available, the tape can be applied more efficiently when compared with manual operations.

DuBroff U.S. Pat. No. 2,972,843 discloses an apparatus typical of machinery developed for taping objects. In this case, the apparatus is adapted to provide a strip of tape around a cluster of cases or cartons located at the top of a stack of the cases. The tape is applied in a horizontal plane, and by securing this upper cluster of cases, the apparatus tends to stabilize the entire stack to facilitate handling.

In the apparatus of this prior patent, a spool of tape is mounted on a support which is adapted to transport the spool around the perimeter of the stack. The support also carries a roller which follows the spool and which engages the tape as it is applied. A clamping and severing device is employed for holding an end of the tape during movement of the spool and for cutting the tape to prepare the apparatus for the next operating cycle.

In this patented system, the stack of cases is supported on a pallet, and the tape-applying mechanisms are mounted on elevated transverse supports whereby the stack can be moved in beneath the tape-applying mechanism. A linkage arrangement is operated through positioning of a stack of cases beneath the tape-applying mechanism whereby a stack of a particular size is required to initiate operation of the apparatus.

BRIEF SUMMARY OF THE INVENTION

The construction of this invention is of the type adapted to apply tape around the perimeter of an object with a supply of the tape being provided on a spool. Support means are provided for the spool, and drive means transport the spool and its support means around the periphery of the object. It will be understood that where reference is made to an "object," it is intended that a wide variety of structures are contemplated. It is particularly understood that the taping may involve a single object or a plurality of objects to be taped into an assembly.

The construction of this invention preferably includes conveyor means for achieving the tape-applying operation in conjunction with a conveyor system. The conveyor system is adapted to bring objects, which may be of varying sizes and configurations, into position adjacent a tape-applying mechanism. At this point, lift means are adapted to raise the objects off the conveyor and into engagement with a stop mechanism. The tape-applying operation is then initiated.

The tape-applying structure includes a roller mounted independently of the tape spool and tape clamping means. This roller moves back and forth over one surface of the object being taped and is adapted to press tape ends in overlapping relationship on the surface.

Both the clamp means and roller means have independent drive mechanisms associated therewith. These independent drives permit movement of the roller means back and forth over a surface of the object to be taped while also imparting a retracting and extending movement to the roller means so that the roller means can be moved out of the path of movement of the tape and then back into operating position at an appropriate stage of the tape applying operation. The independent operating means for the clamp particularly include means for operating a blade employed for severing the tape whereby the construction will be set for repeating its operating sequence.

DETAILED DESCRIPTION OF THE DRAWINGS

Figure 1:
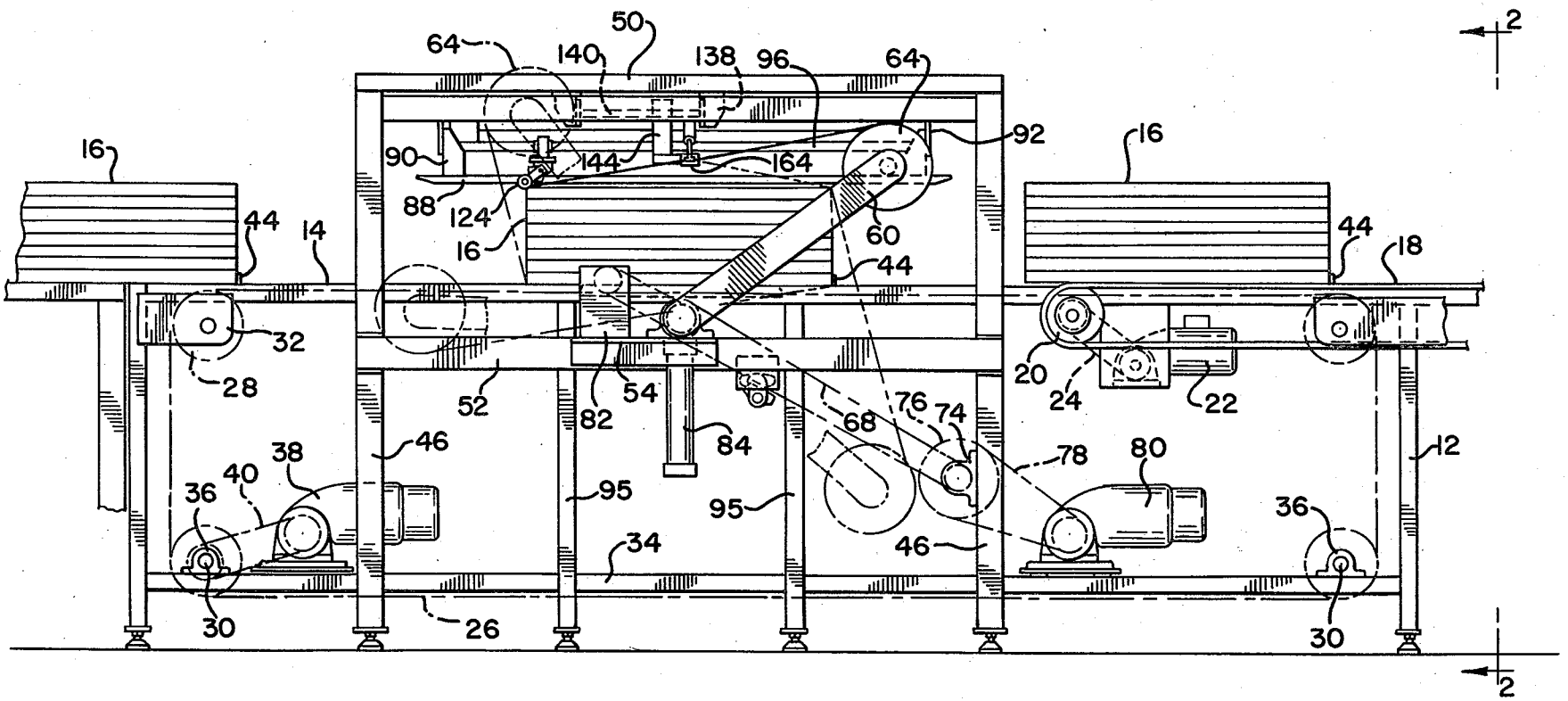
FIG. 1 is a side elevational view of the construction of this invention.
Figure 2:
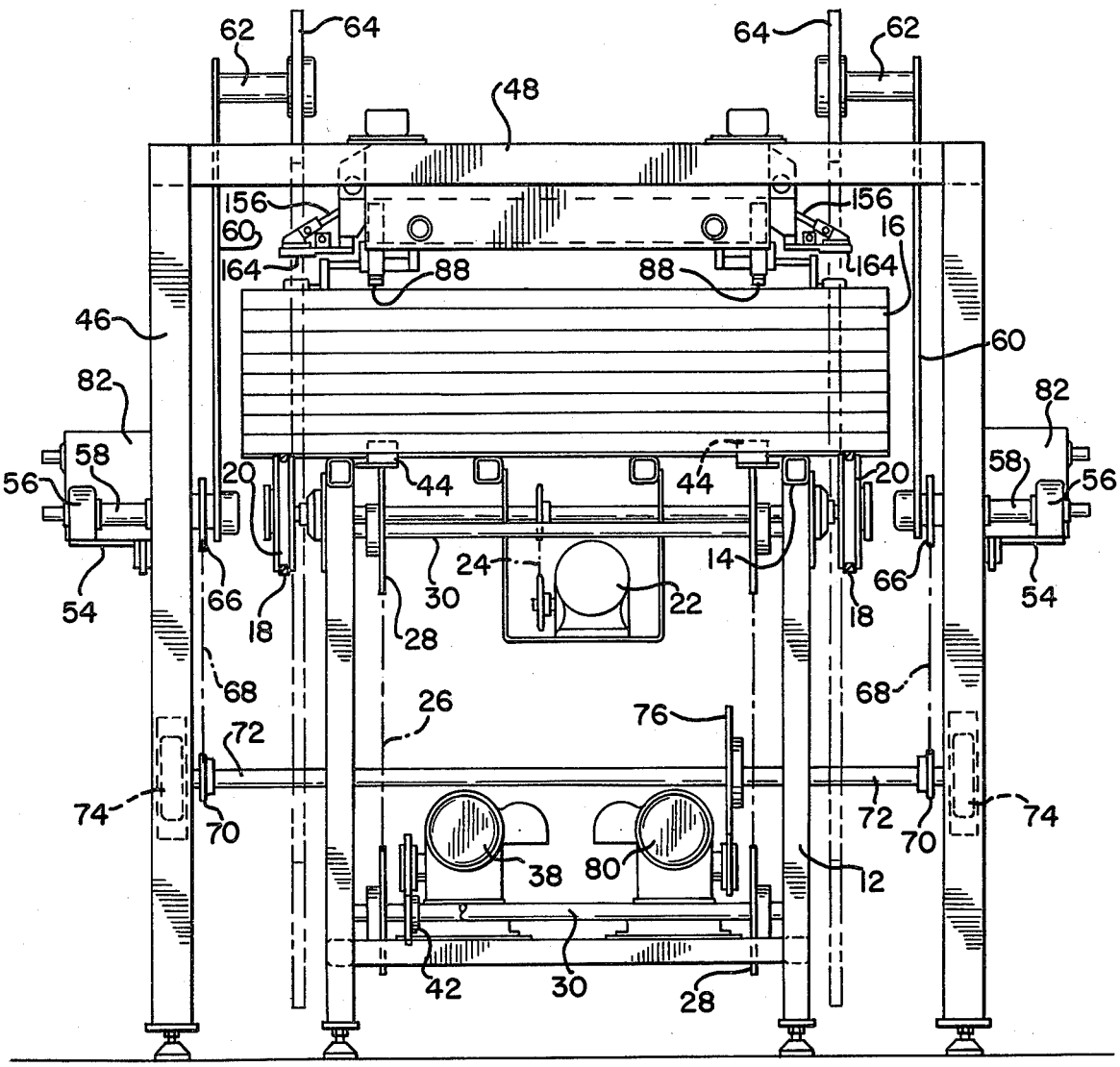
FIG. 2 is an enlarged end view of the construction taken about the line 2—2 of FIG. 1.
Figure 4:
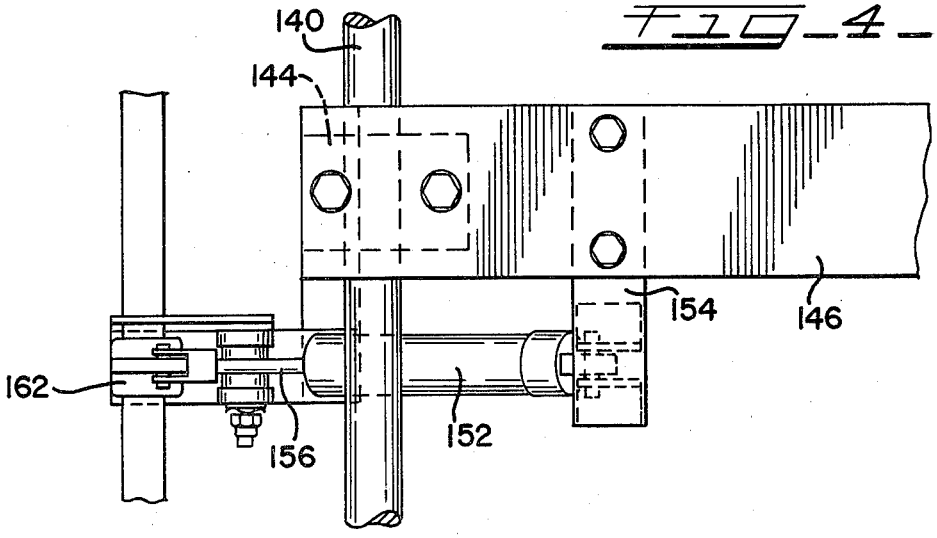
FIG. 4 is an enlarged fragmentary view taken about the line 4—4 of FIG. 3.
Figure 3:
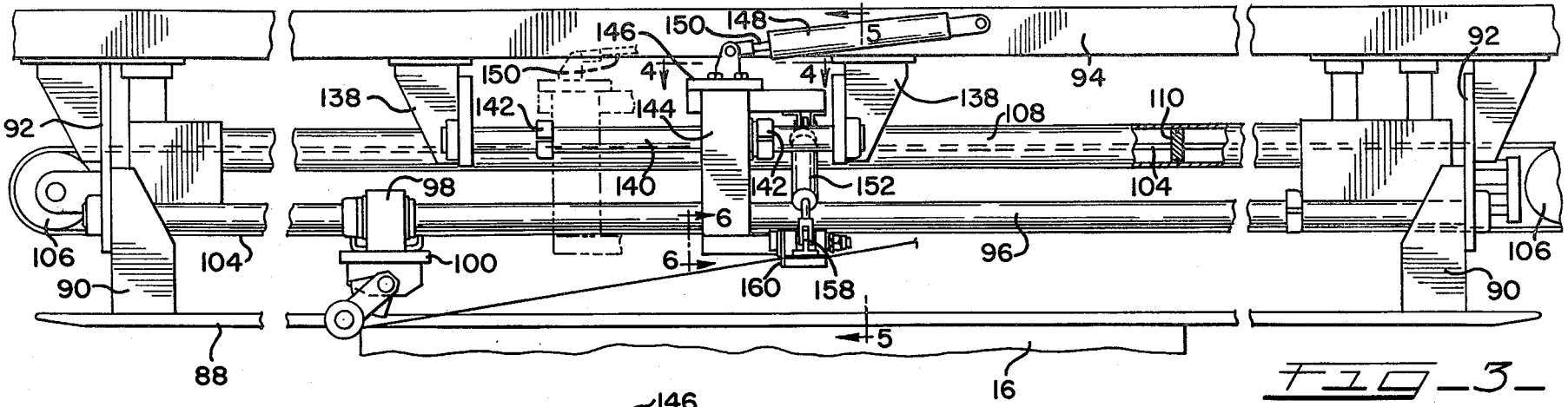
FIG. 3 is an enlarged fragmentary detailed view particularly illustrating the clamping and roller mechanisms.

The construction 10 illustrated in FIGS. 1 and 2 includes a main frame consisting of vertical legs 12 and horizontal beams 14. The objects to be taped are illustrated as stacks 16 of panel-like articles. In an example of the practice of the invention, the articles might comprise foam panels to be used in a production line operation. In such a case, it is desirable to tape the panels into separate assemblies to facilitate handling before use in the subsequent operations. As already indicated, however, the concepts of the invention may be applied for numerous other operations.

The stacks 16 are initially introduced to the system by means of endless conveyor belts 18 mounted on pulleys 20. A drive motor 22 and associated drive belt 24 serve to control movement of the belts 18. This arrangement does not form any part of the invention since the stacks 16 could also be directly placed on the beams 14, for example manually or by means of any suitable lift structure.

An additional conveyor preferably in the form of an endless chain 26 is associated with the apparatus. This conveyor is supported by means of sprockets 28 which are located at opposite ends of horizontally disposed shafts 30. These shafts are located at upper and lower positions relative to the frame with the upper shafts being journalled in plates 32 supported on beams 14. Additional transverse beams 34 support journals 36 for the lower shafts 30.

A motor 38 is connected to the lower rearward shaft 30 through drive belt 40. A sprocket 42 tied to this shaft 30 imparts drive to this shaft while the remaining shafts 30 comprise idler shafts.

The conveyor chain 26 has a plurality of spaced-apart pushers 44 mounted thereon. These pushers operate to pick up a stack 16 which has been positioned on beams 14. By locating the pushers at desired intervals on the conveyor chain 26, the spacing of the succeeding stacks 16 is automatically controlled.

Any suitable means may be employed for starting and stopping motor 38 so that succeeding stacks 16 will be moved into tape-applying position and then moved out of this position after completing of the tape-applying operation. Typically, a mechanical switch would be actuated by the conveyor to insure that the conveyor will stop at the same position after each indexing movement.

The tape-applying mechanisms are supported on a frame which straddles the frame supporting the conveyor 26. This straddling frame includes vertical legs 46 and a plurality of horizontally disposed beams including transverse beams 48, upper longitudinal beams 50, and intermediate longitudinal beams 52.

The legs 46 support outwardly disposed platforms 54 with each platform supporting a journal 56. Shafts 58 extend from these journals and these shafts have support arms 60 fixed thereon. Each of these support arms include inwardly extending sections 62 which rotatably carry tape spools 64.

Sprockets 66 are also fixed to shafts 58, and chains 68 extend from these sprockets to sprockets 70 mounted on shaft 72. This shaft is supported by journals 74 mounted on legs 46. A sprocket 76 is also tied to the shaft 72, and drive chain 78 and motor 80 serve as the drive means for the sprocket 76. With this arrangement, the arms 60 and associated spools 64 are adapted to be transported around the objects 16 as best shown in FIG. 1. The platforms 54 also support housings 82 which include drive mechanisms to control the rotation of the arms 60 as well as suitable controls for the functions of clamping, cutting and pressing. Such mechanisms are known in the art and do not form a part of this invention.

When a stack 16 is positioned beneath the tape-applying mechanisms as shown in FIG. 1, the stack is adapted to be elevated prior to application of the tape. This is accomplished by means of double-acting pneumatic cylinder 84 which includes a piston shaft 87 connected to elevating platform 86. The platform 86 is located between the conveyor chains 26 so that the platform can move beyond the upper flight of the chains.

Figure 11:
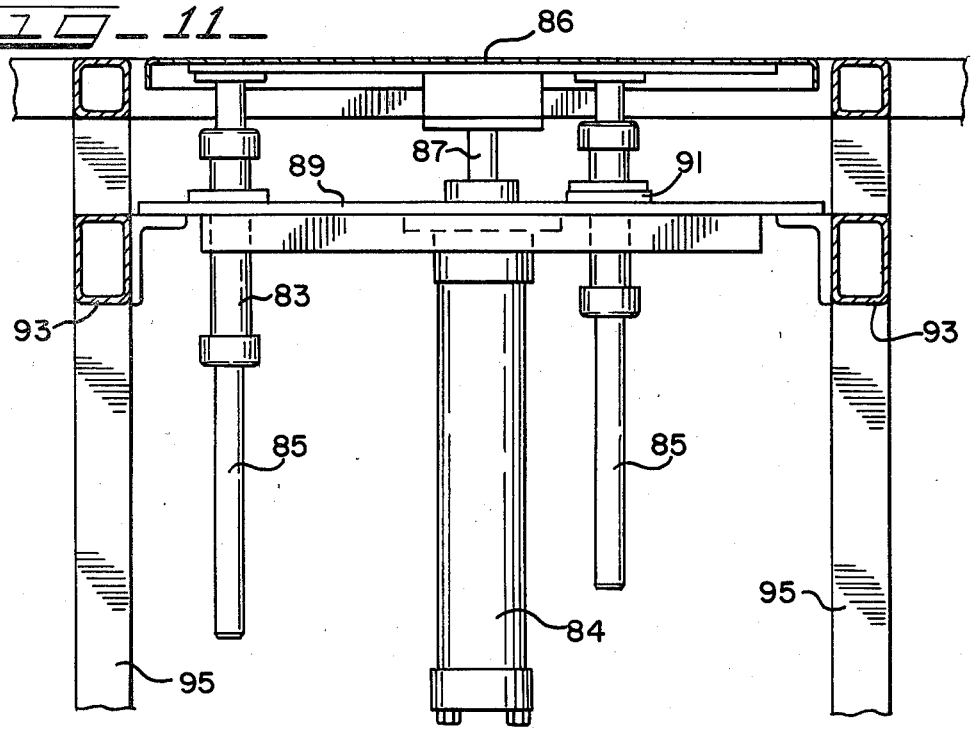
FIG. 11 is an elevational view of an elevating platform utilized in the construction; and, FIG. 12 is a plan view of the platform.
Figure 12:
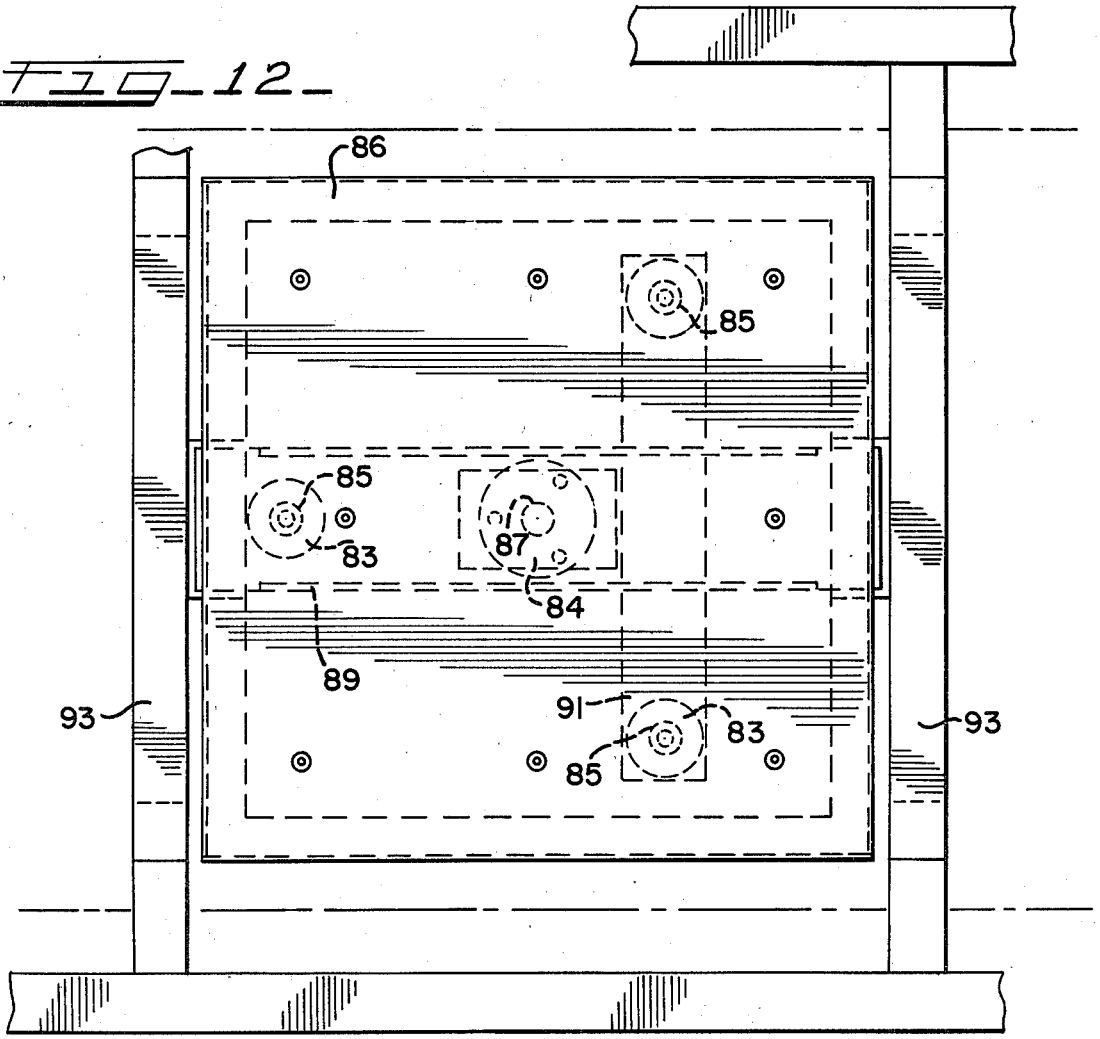

As shown in FIGS. 11 and 12, the platform 86 is supported by three rods 85 with each rod being received by bearing cylinders 83. These cylinders are fixed to plate 89 and crosswise extending plate 91 with the plates being in turn supported on beams 93. These beams extend between intermediate legs 95 connected to beams 14. It will be appreciated that when piston shaft 87 is extended, the rods 85 and associated bearing cylinders maintain horizontal alignment of the platform 86. The extent of movement of the platform is limited only by the length of the rods 85, and such dimensions can be readily controlled depending upon the particular application for the tape-applying construction.

A pair of stop bars 88 are connected by means of brackets 90 and plates 92 to supporting beams 94. These beams 94 are supported in any convenient fashion by the beams 48 and 50. Accordingly, the bars 88 are rigidly connected to the frame so that the platform 86 can only raise the stack 16 to a predetermined upper position. The pressure applied by the cylinder 84 is preferably maintained at a relatively low level so that the stack 16 will not be damaged. This would be particularly true where the material in the stack comprised plastic foam panels or some other material incapable of withstanding high compressive forces.

The plates 92 also support therebetween a pair of longitudinally extending support rods 96. Fittings 98 are associated with these rods for movement along the length of the rods. The fittings are both positioned on plate 100 whereby movement of the plate will simultaneously move the fittings relative to the respective rods 96.

The plate 100 carries a bracket 102 which is tied to flexible drive wire 104. This drive wire extends around sheaves 106 at each end of the frame and into pneumatic cylinder 108. The piston 110 within the cylinder is also tied to the wire 104 whereby movement of the piston within the cylinder operates to drive the wire and the associated plate 100. It will be appreciated that a reciprocating movement is imparted to the plate 100 when the piston 110 is driven back and forth from one end of the cylinder 108 to the other end of the cylinder.

A pair of brackets 112 support a cylinder 114 beneath the plate 100. The shaft 116 associated with the cylinder is connected to rod 118, and this rod is supported by bearing assembly 120 which is also supported beneath the plate 100. The end of the rod 118 is connected to arm 122, and this arm supports roller 124.

The rod 118 also supports a plate element 126. The edges of this element are adapted to engage downwardly extending pins 128. These pins are received in openings defined by the plate 100, and the pins are normally urged downwardly by means of springs 130. Upper supporting threaded pins 132 are tied to transverse support 134 connected to block 136, and the positions of these pins can be adjusted to vary the pressure applied to the element 126.

Figure 9:
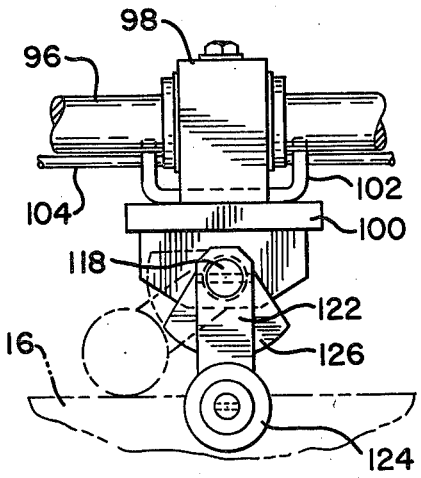
FIG. 9 is a view taken about the line 9—9 of FIG. 7.
Figure 10:
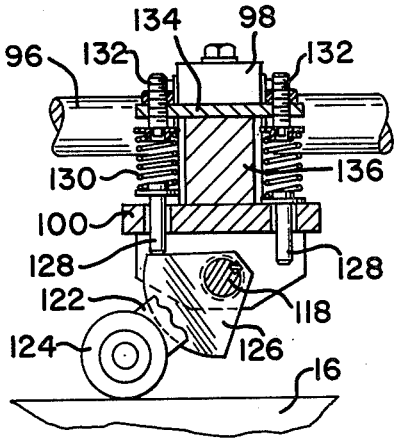
FIG. 10 is a cross-sectional view taken about the line 10—10 of FIG. 7.

The roller 124 functions to apply pressure to tape as the roller is driven over the top surface of stack 16. As best shown in FIGS. 9 and 10, the roller normally hangs downwardly below the top surface but rides up onto the surface when driven onto the stack. The spring-loaded pins 128 provide a means for insuring suitable pressure application by the roller as it moves over the top surface of the stack.

The supporting beams 94 also carry downwardly depending brackets 138, a pair of these brackets being located on each beam on each side of the frame. Each pair of brackets 138 have a supporting rod 140 extending therebetween. The rods 140 support stops 142 in spaced relationship whereby fittings 144 mounted on the rods are adapted to move back and forth for a predetermined distance.

The fittings 144 are connected to a transversely extending plate 146, and cylinder 148 with associated piston shaft are provided for shifting the position of the plate 146. This moves the fittings and associated structure along the supporting rods 140 in a reciprocating fashion.

The structure associated with the fittings 144 comprises a tape clamping and severing means. This means includes a cylinder 152 having one end supported beneath the plate 146 by means of bracket 154. The piston shaft 156 is attached to clamping and cutting element 158. This element defines a cutting edge 160 and a transversely extending gripping portion or pad 162.

Figure 5:
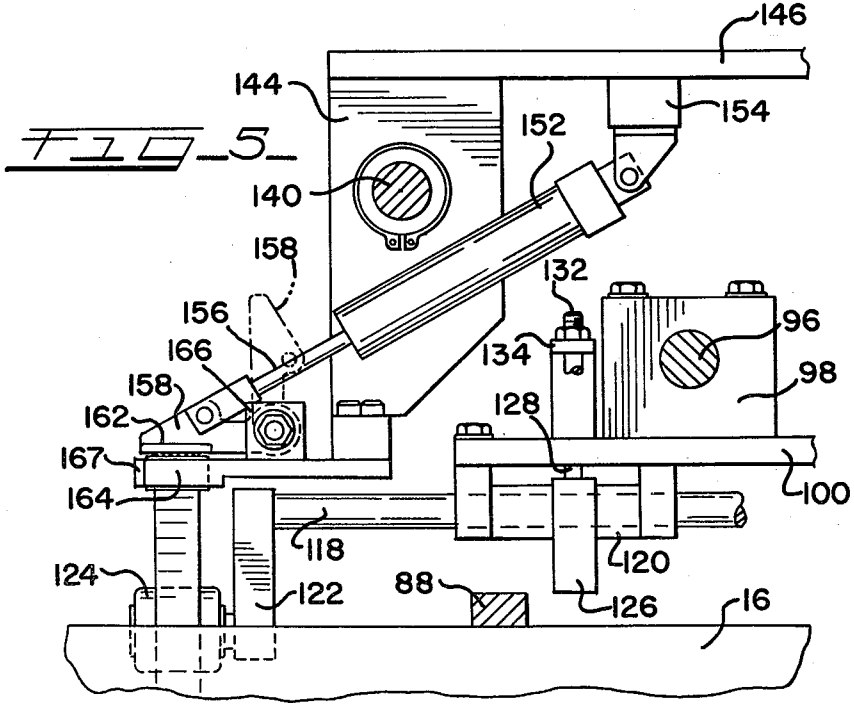
FIG. 5 is an enlarged fragmentary cross-sectional view taken about the line 5—5 of FIG. 3.
Figure 7:
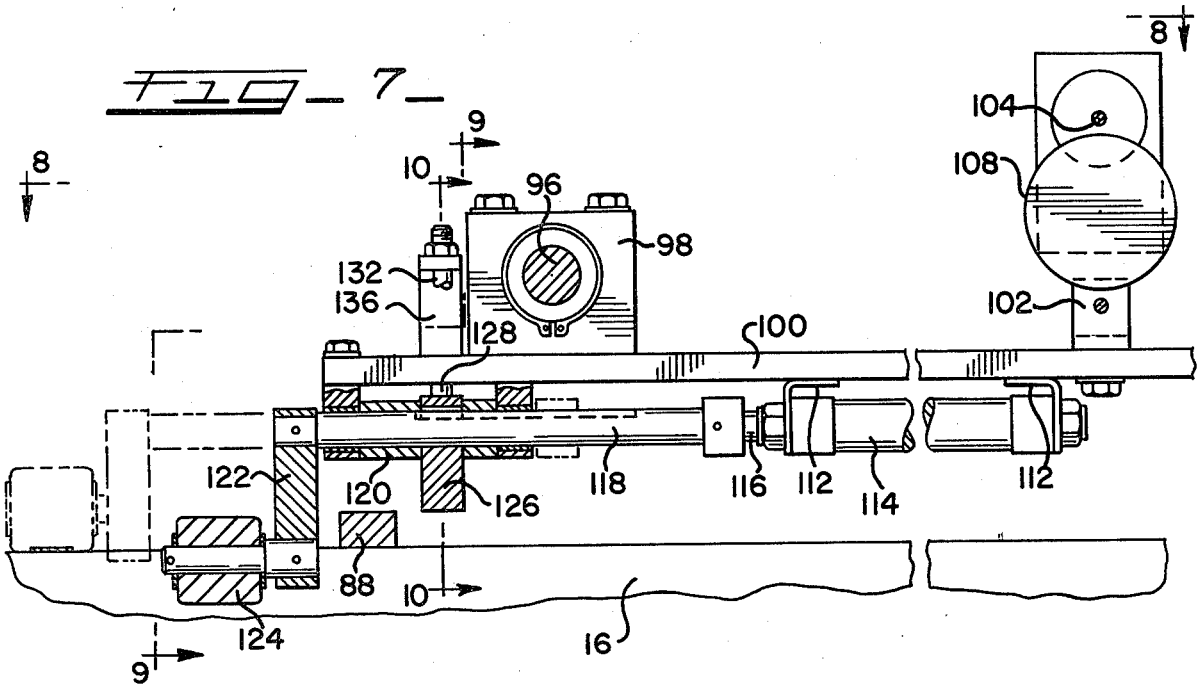
FIG. 7 is an enlarged fragmentary cross-sectional view illustrating details of the respective roller drive means.
Figure 8:
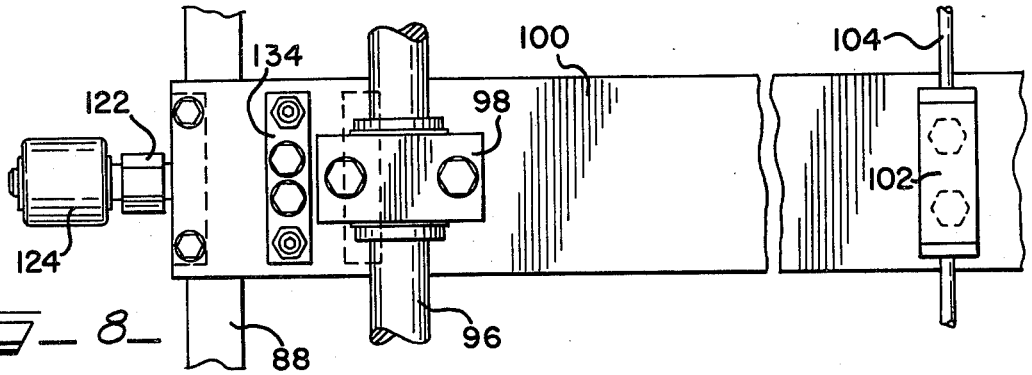
FIG. 8 is a view taken about the line 8—8 of FIG. 7.

An anvil 164 is connected to each fitting 144, and each anvil supports a pivot connection 166 for the element 158. It will be appreciated that when a cylinder 152 is operated to retract shaft 156, the associated element 158 will be pivoted to the dotted line position shown in FIG. 5 thereby exposing the associated anvil 164.

Figure 6A:
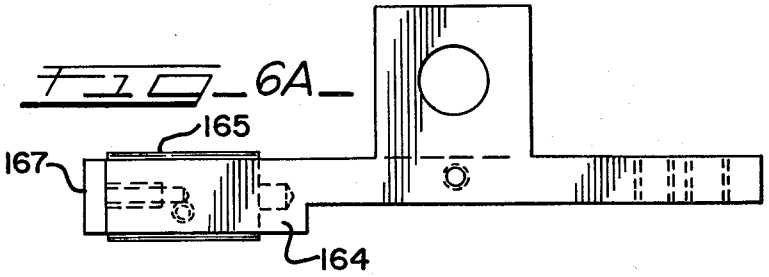
FIG. 6*a* is a detail view of the stationary clamp structure utilized.
Figure 6:
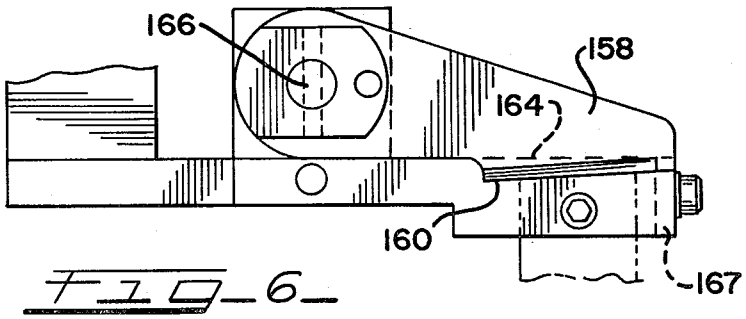
FIG. 6 is an enlarged fragmentary view taken about the line 6—6 of FIG. 3.

As best shown in FIG. 6*a*, the anvil 164 carries roller 165 which is held in place by retainer plate 167. As will be more completely explained, the tape is clamped against roller 165 and when the anvil is exposed and the tape pulled away, the roller will rotate in response to the pulling force thereby facilitating separation of the tape.

In the operation of the construction, stacks or other objects 16 are introduced by means of conveyors 18. These stacks are then moved to a tape-applying position by initiating operation of conveyors 26. As indicated, any suitable limit switch system may be employed for initiating operation of conveyor 26 and for stopping the conveyor when a stack 16 is positioned as shown in the middle of FIG. 1.

After stopping of conveyors 26, the double-acting cylinder 84 is operated to raise platform 86. This drives the top of the stack into engagement with stop bars 88. In the embodiment shown, the stack 16 is approximately maximum size so that only a small elevation of platform 86 is required. The versatility of the apparatus will be apparent, however, since much shorter stacks could be accommodated.

When the stack has been elevated, the motor 80 operates to drive the arms 60 and associated spools 64. In the embodiment shown, the arms will start from approximately the solid line position of FIG. 1. As will be apparent from the following description, the solid line position of FIG. 1 illustrates the condition of the construction just after completion of the transport of the arms around a stack. At this point, the pressure roller 124 is moved across the stack from left to right beyond the edge of the top surface which pulls the lefthand tape portion away from the clamp anvil 164. Accordingly, in the starting position of the construction, only the righthand tape portion of FIG. 1 extends from the clamp anvil to the spool 64. In addition, the roller 124 is on the righthand side of the stack. Finally, the anvil 164 is shown in a righthand position whereas it will be shifted to the lefthand position of FIG. 1 at the start of the tape-applying sequence.

As the spools 64 are transported around the stack, the tape end remains held by the clamps so that the dotted line sections of tape extending from the clamps to a corner of the stack are eventually achieved. At this point, for example, by means of a photocell or limit switch actuated by arms 60, the rollers 124 are moved into operating position by operation of cylinders 114. It will be appreciated that these rollers are held in a retracted position by the cylinders so that the rollers will not interfere with the placing of the tape on the stack. Once the tape has been applied, the rollers are extended into the operating position.

The drive wire 104 for the rollers 124 is then operated to move the rollers across the top surface of the stack and beyond the edge. When the rollers engage the respective strips of tape, the tape will be pulled away from the anvil rollers 165 of the opened clamps and pressed by the rollers 124 against the surface. The clamps are opened by operation of cylinders 152, and this function may be controlled by the same means which initiate operation of the drive wire for the rollers 124.

When the rollers 124 have completed movement across the top surface, the rollers are again retracted by cylinders 114 to thereby provide clearance for the tape as the spools 64 complete their cycle. In addition, the shaft 150 of cylinder 148 is extended to move the clamp anvils 164 and associated structure to the righthand position of FIG. 1. The anvils 164 are exposed and this brings the tape onto the anvil surfaces as the spools 64 move to the solid line position of FIG. 1. The piston shafts 156 are then extended to achieve cutting of the tape while at the same time clamping a tape end in preparation for the next cycle of operation.

The rollers 124 are thereafter moved to operating position by operation of cylinders 114. These rollers are then driven from left to right by means of drive wire 104 whereby an additional tape section is pressed against the surface of the stack. It will be appreciated that the rollers will pull this tape section away from the clamp if the section does not automatically fall onto the top surface when it is severed. It will also be appreciated that the mechanism described provides for a substantial overlap of the tape sections. Thus, the indexing of the clamp structure insures a substantial overlap and thereby provides more secure assembly of the stack.

When the rollers 124 have been moved to a righthand position, the rollers are retracted by operation of cylinders 114. A new stack is then moved into position, elevated, and the operating sequence then repeated.

It will be understood that various changes and modifications may be made in the above described construction which provide the characteristics of the invention without departing from the spirit thereof particularly as defined in the following claims.

That which is claimed is:

1. In a construction for applying tape around the perimeter of an object wherein a supply of tape is provided on a spool, support means are provided for the tape, and means are provided for transporting the spool and its support means around the periphery of the object, said tape being dispensed from the spool during its movement around the object whereby the tape is brought into engagement with said periphery, roller means including a single roller for engaging said tape, said roller means being movable over one surface of said object to press a section of tape into engagement with the surface, a roller means support, and drive means for said support, the improvement comprising means operating said drive means to drive said roller means across and beyond said one surface when pressing a first tape section into engagement with said one surface, and means operating said drive means to drive said roller means back across said one surface after said spool completes its movement around said periphery whereby said roller means engages an additional section of said tape during its return movement for pressing said additional section against said one surface.

2. A construction in accordance with claim 1 wherein said spool and associated tape are movable around said object in a vertical plane.

3. A construction in accordance with claim 1 comprising lift means for supporting said object, drive means associated with said lift means whereby an object supported by said lift means is adapted to be moved vertically, stop means for engaging said object for limiting the movement of the object by said lift means, and means for initiating the application of said tape when said object is engaged with said stop means.

4. A construction in accordance with claim 3 including a pair of said spools mounted on opposite sides of said lift means, rotary arm means positioned beyond the extent of said object supporting the respective spools, and means for driving said arm means for transporting said spools around the object whereby tape is applied around spaced-apart peripheral areas of said object.

5. A construction in accordance with claim 3 including a conveyor for said object, means for driving said conveyor to move said object into position over said lift means, operation of said drive means associated with said lift means moving said object off the conveyor, and returning said object to said conveyor after application of said tape.

6. A construction in accordance with claim 5 wherein said conveyor comprises spaced apart endless drive means, said lift means being positioned between said endless drive means whereby said lift means is adapted to move vertically between said endless drive means.

7. A construction in accordance with claim 1 including separate means for moving said support for said roller means to locate the roller means in a first position out of the path of movement of said spool, and for moving said support to a second position into the path of movement of said spool whereby the roller means is adapted to engage said tape sections.

8. A construction in accordance with claim 7 including means for pivotally connecting said roller means to said support, and resilient means adapted to press against said roller means when the roller means is pivoted in either direction relative to the support, said resilient means operating to press the roller means against the tape as the roller means moves over said one surface.

9. In a construction for applying tape around the perimeter of an object wherein a supply of tape is provided on a spool, support means are provided for the tape, and means are provided for transporting the spool and its support means around the periphery of the object, said tape being dispensed from the spool during its movement around the object whereby the tape is brought into engagement with said periphery, clamp means for clamping an end of said tape, and roller means including a single roller movable over one surface of said object for engaging the tape and pressing the tape onto said one surface, the improvement wherein said clamp means are positioned opposite said one surface, said roller means being adapted to engage said tape subsequent to transporting of the spool for a distance sufficient to unroll a first section of tape between said clamp means and a surface other than said one surface, means driving said roller means over said one surface in one direction to pull said first tape section away from said clamp means, to press the first tape section into engagement with said one surface and to drive said roller means beyond said one surface after pressing said first tape section into engagement with said one surface, and means driving said roller means back across said one surface in the opposite direction after said spool completes its movement around said periphery to engage an additional section of said tape during such return movement and to press said additional section against said one surface, and including means for shifting the position of said clamp means in said opposite direction after said roller means presses said first section of the tape against said one surface and before said roller means presses said additional section of said tape against said one surface whereby said additional section overlaps said first section by a substantial amount.

10. A construction in accordance with claim 9 wherein said means for transporting the spool operates to bring said tape into engagement with said clamp means after the transporting means completes its movement around the periphery of the object, and including blade means associated with said clamp means for severing said tape.

11. A construction in accordance with claim 9 wherein said clamp means includes relatively movable members, one member defining a tape engaging pad and the other member including a roller, said pad pressing the tape against the clamp roller when the clamp is closed and said clamp roller rotating to facilitate separation of the tape from the clamp roller when the clamp is open.

* * * * *